US011447360B2

(12) United States Patent
Thurnherr et al.

(10) Patent No.: US 11,447,360 B2
(45) Date of Patent: Sep. 20, 2022

(54) APPARATUS AND METHOD FOR PRODUCING PRINTED PRODUCTS

(71) Applicant: Müller Martini Holding AG, Hergiswil (CH)

(72) Inventors: Martin Thurnherr, Roggliswil (CH); Pascal Erni, Pfaffnau (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 17/172,208

(22) Filed: Feb. 10, 2021

(65) Prior Publication Data

US 2022/0250868 A1 Aug. 11, 2022

(51) Int. Cl.
*B65H 43/00* (2006.01)
*B65H 37/04* (2006.01)
*B41M 7/00* (2006.01)

(52) U.S. Cl.
CPC ..... *B65H 43/00* (2013.01); *B41M 7/00* (2013.01); *B65H 37/04* (2013.01)

(58) Field of Classification Search
CPC ..... B65H 9/108; B65H 5/22; B65H 5/228; B65H 5/32; B65H 29/24; B65H 29/245; B65H 2301/4461
See application file for complete search history.

(56) References Cited

U.S. PATENT DOCUMENTS 3,581,753 A * 6/1971 Ages ..... F23N 5/247 137/66
3,763,628 A 10/1973 Bodolay
4,085,927 A 4/1978 Muller
4,572,071 A * 2/1986 Cappel ..... B65H 5/228 101/183
6,581,753 B1 * 6/2003 Brewster ..... B65H 5/085 198/470.1
7,269,475 B1 * 9/2007 Hogg ..... B65H 5/228 406/19

(Continued)

FOREIGN PATENT DOCUMENTS

CH 586611 A5 4/1977
EP 1285872 A1 2/2003

(Continued)

OTHER PUBLICATIONS

German Search Report in related German Patent Application No. 10 2021 103 056. 0, dated Sep. 28, 2021, 4 pages with English Google Translation.

*Primary Examiner* — Leslie A Nicholson, III
(74) *Attorney, Agent, or Firm* — FisherBroyles, LLP; Robert Kinberg

(57) ABSTRACT

An apparatus for producing printed products such as books, magazines, brochures, catalogues or the like comprises several connected devices for the processing of printed sheets. The printed sheets are admitted with blast air via at least one air supply in order to change or maintain their position. At least two of the connected devices are respectively provided with at least one blower for generating blast air. The blast air can be used in the respective device. The blowers are connected to a control unit of the apparatus so that the blast air generated by the blowers can be controlled as needed.

28 Claims, 6 Drawing Sheets

(56) References Cited

U.S. PATENT DOCUMENTS

| | | | | |
|---|---|---|---|---|
| 7,905,475 | B2 * | 3/2011 | Pruzan | B65H 5/32 270/52.28 |
| 7,976,002 | B2 | 7/2011 | Hoffmann et al. | |
| 8,925,917 | B2 * | 1/2015 | Watanabe | G03G 15/6511 271/211 |
| 10,569,981 | B2 * | 2/2020 | Sawicki | B65H 9/108 |
| 10,717,622 | B2 * | 7/2020 | Koch | B41F 13/70 |
| 10,981,742 | B2 * | 4/2021 | Terrero | B65H 29/16 |
| 2009/0184453 | A1 | 7/2009 | Pruzan et al. | |

FOREIGN PATENT DOCUMENTS

| | | | |
|---|---|---|---|
| EP | 1839897 | A2 | 10/2007 |
| JP | 2014121853 | A | 7/2014 |

* cited by examiner

APPARATUS AND METHOD FOR PRODUCING PRINTED PRODUCTS

BACKGROUND OF THE INVENTION

The invention relates to an apparatus and a method for producing printed products, such as books, magazines, brochures, catalogues or the like, comprising several connected devices for processing of printed sheets, wherein the printed sheets can be admitted with a blast air via at least one air supply, either to change or maintain their position.

Printed products such as newspapers, magazines, brochures or books are produced in post-processing machines from printed webs or printed sheets. Blast air devices are arranged in some locations along transport sections and in processing stations of the post-processing machines, which allow changing the position of the printed sheets or to maintain a desired position. Especially with fast-operating machines, where processing and transport steps follow within temporally short operating cycles, it is often impossible to operate without blast air. The use of blast air in the first place allows moving different printed sheets with a high degree of reliability, at the correct instant, and with a correct orientation to a specific location and to hold them in this location.

Swiss patent document CH586611A5 describes a gathering machine with feeders arranged along a gathering section. With the aid of a withdrawing drum, feeders separate the supplied printed sheets. Two counter-rotating opening drums of a feeder open up and respectively place the separated printed sheets onto a sword arranged above and parallel to the saddle-shaped gathering chain. To ensure that even at high movement speeds the opened sheets are deposited in a controlled manner, meaning in the correct position and at the correct instant in the region of the two opening drums, onto the sword, guide elements with guide surfaces are arranged in a lower region of spreading drums, on both sides of the gathering chain. The outside edges of the printed sheets, which extend parallel to the gathering chain, slide downward along the guide surfaces following the opening. Above the guide surfaces, the guide elements additionally have bores embodied as blast air nozzles, with a cross-sectional surface of a few $mm^2$, which push the opened ends of the printed sheets downward with the aid of the downward-directed air stream. Thanks to the blast air, the printed sheets can be deposited faster onto the sword. Carriers on the gathering chain grip the printed sheets positioned on the sword along their trailing edges which extend crosswise to the gathering chain. At the end of the sword, the printed sheet drops on top of the printed sheets already positioned on the gathering chain and is transported along with these. During the transport, the blast air presses the printed sheets against the printed sheets positioned underneath, thus preventing these from being raised or even lifted off by the air flow. A higher conveying speed of the gathering chain is therefore possible than would be possible without the use of blast air. The blast air is conducted from a central blast air source via a blast pipe, respectively arranged behind and in front of the gathering section, to the guide elements provided with blast air openings. The control of the blast air pressure cannot be adapted to the requirements of an individual feeder. The volume flow of blast air can only be adapted with manually controlled shut-off elements to the conditions in the region of the sheet feeder. Blast pipes, which are several meters long and extend through the complete gathering machine, cause a pressure loss that must be compensated by the blast air source. Based on experience, the many blast air nozzles arranged on both sides along the gathering chain, which have a relatively small exit cross section, cause interfering noise emissions. A further source of noise are the high-capacity compressors needed for generating the blast air. In part, these compressors are installed in sound-insulating rooms to lower the sound level in the production rooms. In that case, the compressed air must be supplied to the machines for producing printed products via long hoses or pipelines which cause losses.

A different apparatus for gathering printed sheets, positioned straddling, is disclosed in the European patent document EP 1285872A1. In the region of the gathering section, individual machine frames are arranged side-by-side and are connected to each other. One machine frame can respectively accommodate two feeders and comprises pipe sections for the connection to the pipe sections of neighboring machine frames. The connected pipe sections, jointly forming a several meters long pipeline for blast air and vacuum, are connected at one point to a central blast air and vacuum source and comprise exits and points of intersection for each feeder. The machine frames also accommodate the supports for the gathering chains and have holders for pneumatic printed sheet guides, arranged on both sides along the gathering chain. The printed sheet guides are connected to the pipe sections for blast air. The amount of air flowing out of the small bores in the printed sheet guides, measuring only a few $mm^2$, can be adjusted via manually operated valves. Lines for electricity, control, and compressed air furthermore extend in the lower region of the machine frames, along the gathering section. The distribution of the centrally generated blast air to the consumers arranged along the gathering section, for example the pneumatic printed sheet guides or the blast air nozzles in the sheet feeders, also results in great losses and has many points of intersection. In case of a production change or a change in the production speed, the blast air supplied for guiding the printed sheets along the gathering section must be readjusted by means of the valves for the sectionally operating printed sheet guides. For example, the blowing direction and the flow amount must be adjusted manually each time to the new production conditions.

With an apparatus as disclosed in U.S. Pat. No. 3,763,628, paper bags at a supermarket cash register can be opened without additional personnel and the merchandise then placed automatically into these bags. Air is blown with a blower from below against the upper end of a stack of folded bags. A gripper holds the bag by the lower edge so that it remains fixed at that location and is not blown away by the air stream. As soon as a suction arm, arranged in the apparatus, suctions in the bottom of the still folded upper bag and tilts it up, the air stream of the blower can blow up the bag by the open end. The merchandise positioned in a compartment can subsequently be pushed by a pusher into the open bag, the gripper then releases the bag and the filled bag is placed upright for a client to remove it. The operation for opening paper bags is always identical, and the individual operational steps of the devices always occur at the same speed. The air stream coming from the single blower cannot, and does not have to be, adapted to changing production conditions or different bag formats, types of paper, and the like. The effect of the blast air can only be used at one and the same location in the apparatus and with the same effective direction.

SUMMARY OF THE INVENTION

It is an object of the invention to create an energy-saving, requirement-depending and controllable, compact and costeffective apparatus for generating blast air for devices arranged along a paper-processing machine and wherein noise emissions for generating and using the blast air furthermore are minimized.

The above and other objects are solved with an apparatus for producing printed products, such as books, magazines, brochures, catalogues or the like, which in one embodiment includes: a plurality of connected devices for processing printed sheets; an air supply including blowers that generate blast air, wherein at least two of the connected devices are each arranged to use blast air of respectively first and second blowers so that the printed sheets processed by each connected device can be admitted with blast air either to change or maintain a position of the printed sheets; and a control unit arranged to control the blast air generated by the blowers.

For the first time, the devices of a paper-processing machine are respectively provided with one or several blowers by means of which the blast air, used for processing the printed sheets, can be generated inside the apparatus itself. The expensive, high-capacity compressors for providing the blast air are omitted, along with the exhaust air and noise emissions generated by the compressors, along with the several meters long pipe sections or hoses used for conducting the blast air from a central blast air source to the individual device regions where the blast air is utilized. Also unnecessary are the connecting locations between pipe sections, hoses and distribution channels, which must be sealed to avoid losses. Detachable points of intersection between stationary and exchangeable devices of an apparatus are also omitted. The connection between the blowers and the control unit allows for controlling the blast air as needed, meaning only enough blast air is generated directly inside a device and is conducted to the concerned region within the same device, as is needed for the secure and careful processing of printed sheets inside the device at a specific point in time. In addition to omitting the above-described compressors, this need-based control also allows saving energy and avoid unnecessary noise. The apparatus according to the invention therefore makes it possible to avoid the disadvantages of the prior art during the generating and distribution of blast air inside devices of a paper-processing machine.

According to one modification of the apparatus according to the invention, the at least one air feed comprises a distribution channel with at least two spaced-apart blast pipes. With the aid of the at least two blast pipes, the blast air can be channeled precisely into the region where the blast air is to be effective. Since printed products are flat, the effect of the blast air used on the printed products is higher when it exits not only from one but from at least two adjacent locations from the air feed and hits the printed products.

According to a different embodiment of the inventive apparatus, the distribution channel and/or one of the at least two blast pipes has a flow-optimized geometry. In this way, blast air turbulences in the distribution channel and/or in the blast pipes can be avoided or reduced because this turbulence in the air supply causes losses. The impulse force of a blast air flow coming out of a blast pipe furthermore increases if the flow has less turbulence and is as unidirectional or laminar as possible.

The distribution channel and the spaced-apart blast pipes of a different embodiment of the apparatus according to the invention are embodied as one part. The number of components and intersections are reduced. The assembly of the distribution channel and the blast pipes is simplified, thereby reducing costs.

According to another modification of the inventive apparatus, each blower is connected on the output side directly to the distribution channel. The path which the blast air generated by the blower must travel from the blower output to the exit openings of the blast pipes is thus very short. Pressure and flow losses are further minimized in this way.

The blast pipes according to a further embodiment of the inventive apparatus respectively have a minimum flow cross section, with a surface area of between 10 and 2000 $mm^2$ advantageously between 50 and 400 $mm^2$, especially advantageously between 100 and 200 $mm^2$, for the flow-through of blast air. In order to support a change or maintain the position of printed sheets, the blast-air pipes known from the prior art have several small openings through which the blast air flows out. For example, each opening can have a diameter of 0.5 to 2 $mm^2$. According to the prior art, blast air is oftentimes used based on the principle "small volume flow—high flow speed." High speed is necessary for the blast air to exit through the small openings and act upon the printed sheets with the desired force. The inventive apparatus uses the principle of "high volume flow—low flow speed." This principle has the advantage of noticeably lowering the noise level generated when blast air flows with low flow speed through larger exit openings.

According to another embodiment of the inventive apparatus, the blast generated by the blowers on the exit side has a maximum overpressure of 0.1 bar, advantageously of maximum 0.01 bar, especially advantageously of maximum 0.007 bar. For the previously described principle of a "high volume flow—low flow speed" according to the preceding embodiment, which is realized for the inventive apparatus, the blast air must be compressed only slightly. As a result, a high amount of energy can be saved which would otherwise be needed for compressing the blast air according to the prior art with the aid of high-capacity compressors that results in high losses. The air feed can have a lighter design owing to the lower pressure level, and the intersections hardly need to be sealed against losses. The costs for designing the air feed and for generating the blast air can thus be lowered.

The inventive apparatus according to a different embodiment is designed as a gathering and stapling machine or as a saddle stitcher. At least two of the connected devices for processing printed sheets are sheet feeders of a saddle stitcher. With these sheet feeders, printed sheets are separated, opened and deposited onto a gathering chain moving in conveying direction. At least two sheet feeders respectively are equipped with a separate blower for generating the blast air. The blast air can be blown out via the distribution channels and blast pipes, arranged on both sides of the gathering chain as seen in conveying direction. Gathering and stapling devices have a lengthwise expansion as a result of stringing together devices such as sheet feeders, measuring and testing equipment, a stapling device and a sheet delivery. It is therefore advantageous if the blast air does not have to be channeled to the individual devices from a central blast air source via pipes and hoses measuring several meters. With a local generating of the blast air by at least one blower in each of the at least two sheet feeders, these can also be arranged more flexibly along the gathering chain since the points of intersection to the pipes for distributing the blast air are omitted.

For a different embodiment of the inventive apparatus, at least one of the devices is designed as conveying element for transporting printed sheets. During the transport on the conveying element, the printed sheets are admitted with blast air via distribution channels and blast pipes arranged along the gathering chain. Owing to this design, the position of the printed sheets gathered and transported on the conveying element can be maintained even at high conveying speeds. The printed sheets, which are not yet joined, otherwise have a tendency to lift up or off at high conveying speeds due to the movement airflow.

According to yet another embodiment, the blast air generated by the blowers can be adjusted in dependence on parameters such as the production speed, the type and grammage of the printed papers which are folded to form a printed sheet, the format, the number of pages or the type of folding for the printed sheet, the configuration of the printed product, the use of guide elements, the arrangement of devices within the apparatus. As a result, the blast air requirement can be adapted individually, flexibly and constantly to the production conditions and the given conditions of an individual device. For example, if the production speed is reduced, the blast air can also be adjusted immediately to the required amount or can even be turned off, which results in a saving of the energy required to generate the blast air.

Corresponding to a different embodiment of the inventive apparatus, the control unit can determine operating data for the blowers in dependence on the parameters and can actuate the blowers with the ascertained operating data. The advantage is that immediately following a change in the parameters, the control unit can actuate the blowers with the new operating data, without requiring a manual intervention.

According to yet another modification of the inventive apparatus, the parameters or the operating data for each device blower can be adjusted via a local display or control unit installed on the device or via a central control unit for the apparatus. An operator for the apparatus can thus influence easily the control for each individual blower, either by manually changing the parameters or by adjusting or optimizing the operating data for the blowers which are determined by the control.

According to a further embodiment of the inventive apparatus, the parameters and the operating data relating to a production order or an operating mode for each blower can be stored in the control unit and can be called up again. With recurring production orders, for example, the parameters and operating data stored and perhaps entered or optimized by the machine operator, can thus be called up easily and quickly if necessary. A further renewed searching by the operator for optimum operating data for the blowers is not necessary. If several machine operators work at the same apparatus for producing printed products, for example in case of a shift operation, they can exchange the stored data.

The object is furthermore solved according to another aspect of the invention, by a method for producing printed products such as books, magazines, brochures, catalogues and the like employing the apparatus first described above, which in one embodiment includes: processing the printed sheets in the connected devices; generating the blast air with aid of the blowers; admitting the printed sheets with the generated blast air only in a region of the respective connected devices to change or maintain the position of the printed sheets; and controlling the blast air generated by the blower with the control unit.

The same advantages as from the apparatus according to the invention and its modifications also follow from the method according to the invention, as well as from additional embodiments of the method according to the invention.

Further advantageous features follow from the dependent patent claims, the description below, as well as from the drawings.

BRIEF DESCRIPTION OF THE DRAWINGS

Exemplary embodiments of the invention are explained in further detail in the following with the aid of the drawings, showing in.

DETAILED DESCRIPTION

Figure 1:
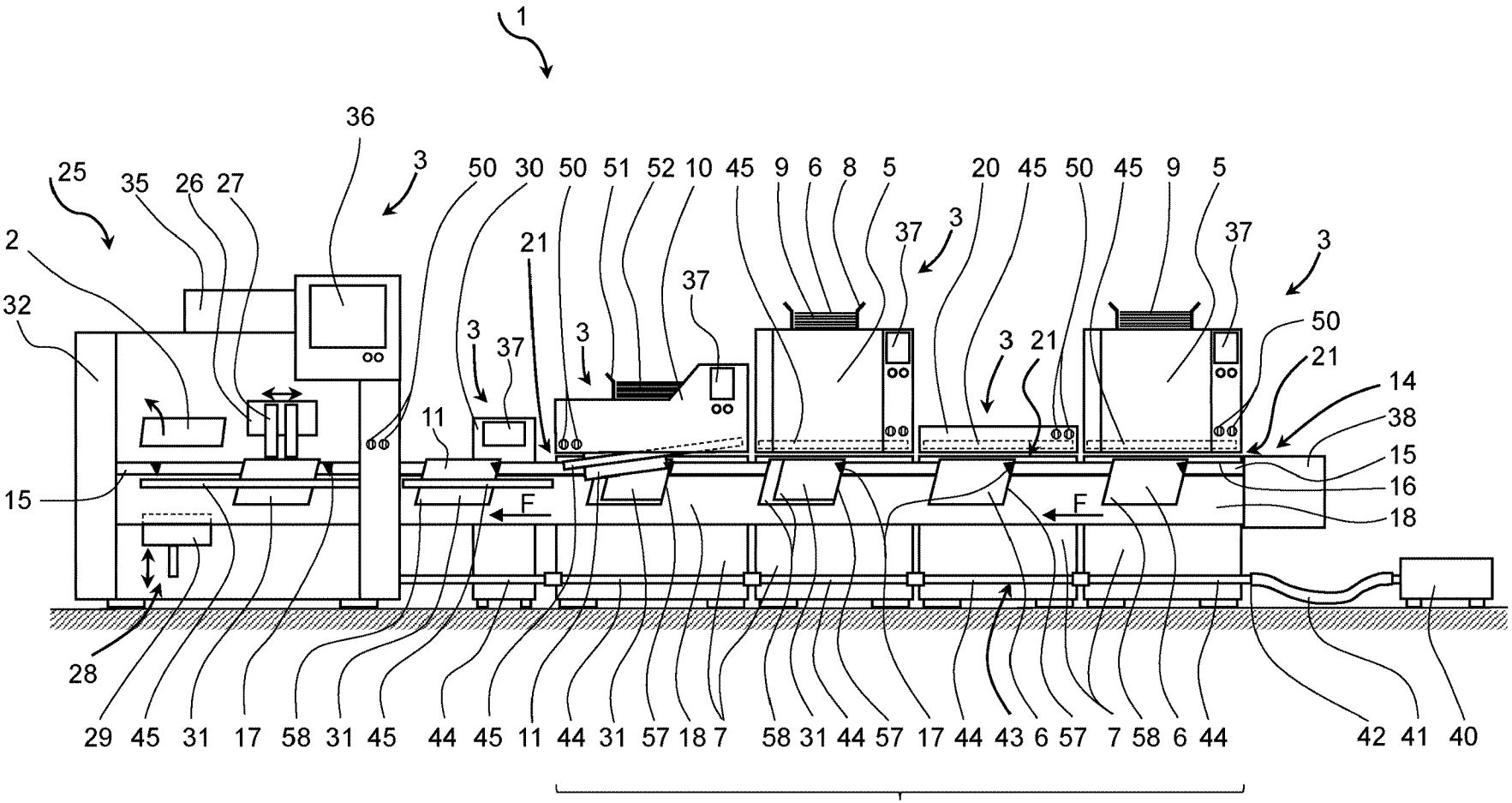
Fig. 1 (Prior Art)
FIG. 1 A schematic representation of a gathering and stapling device according to prior art.

FIG. 1 schematically shows an apparatus 1 according to the prior art, embodied as a gathering and stapling device, for producing printed products 2. A gathering and stapling device is comprised of individual devices 3 which are connected, for example mechanically, pneumatically, electrically, and/or via control lines. Sheet feeders 5 and other devices 3 for processing printed sheets 6 are arranged side-by-side along a gathering section 4. Conveying elements 14 transport the printed sheets 6 and all intermediate products up to the finished printed product 2 with the apparatus 1 to the location where they are transferred to a following apparatus. In the field of post-print processing, the terms processing or handling refer to all operating steps relating to the printed sheets, for example transporting, conveying, rotating, turning, orienting, fixing, clamping, opening, closing, measuring, testing, counting, identifying, printing, stapling, applying adhesive, gluing, stamping, cutting, milling, grinding, pressing, forming, folding, redirecting, separating, grooving, perforating, inserting, placing on top, gathering, sorting, stacking, packaging, heating, cooling, and the like. The sheet feeders 5 are attached so as to be detachable to machine frames 7, so that their position along the gathering section 4 can be changed. The example in FIG. 1 shows two sheet feeders 5, mounted on the four machine frames 7, for processing sheet stacks 9 that are positioned flat inside sheet hoppers 8, as well as a sheet feeder 5 embodied as a fold feeder 10 for processing non-folded covers 11. A conveying element 14, which circulates below all the sheet feeders 5 and is embodied as gathering chain 15, comprises a ridge line 16 as for a roof and is provided with regularly spaced-apart carriers 17 for transporting the printed sheets 6. Below the gathering chain 15, guide sheets 18 adjoin the ridge line 16 of the gathering chain 15. Gathering sections are furthermore known from the prior art which comprise a gathering chain 15 without guide sheets 18.

An empty space remains for an additional sheet feeder 5 between the two sheet feeders 5. The missing sheet feeder 5 was removed, for example for maintenance operations, and a blind cover 20 attached in its place to the machine frame 7. The blind cover 20 covers mechanical and electrical points of intersection 21 on the machine frame 7, which are needed for fastening the sheet feeders 5. For safety reasons, the blind cover 20 extends past the gathering chain 15 positioned below it.

Downstream of the fold feeder 10, a stapling machine 25 is arranged which comprises an oscillating stapling device 26 with two stapling heads 27 and a delivery 28. With the aid of an up and down movable ejector 29, the stapled printed products 2 in the delivery 28 are lifted off the gathering chain 15 and are supplied to a further processing device that is not shown, for example to a trimmer. Between the last sheet feeder 6 or the fold feeder 10 in conveying direction F of the gathering chain 15 and the stapling device 25, a quality control unit 30 is arranged at the rear of the gathering chain 15. This unit, for example, serves to measure the thickness of a printed sheet stack 31, gathered so as to be positioned astride the gathering chain 15, and to check the position of the individual printed sheets 6 or the stack 11.

The gathering and stapling machine comprises a control unit 35, arranged inside a casing 32 of the stapling device 25. This control unit is connected to a central control unit 36 which is also attached to the stapling device 25 and contains local display and operating units 37, as well as non-depicted sensors and operating and adjustment elements for the devices 3.

A non-depicted drive device and a first deflection unit for the gathering chain 15 is provided inside the casing 32 of the stapling device 25, in the region of the delivery 28. At the start of the gathering section 4, a second deflection unit as well as a tensioning station for tensioning the gathering chain 15 are arranged below a cover 38, shown in FIG. 1.

A blast air source 40, embodied as compressor, which supplies the gathering and stapling device with blast air is shown to the right of the gathering and stapling device. Larger and/or several compressors are required for long gathering and stapling devices comprising numerous sheet feeders 5. To protect operating personnel from noise emissions of the compressors, these are in part installed in separate rooms. The blast air which is compressed to 1 to 1.5 bar overpressure is connected via suitable hoses 41 or pipes to a connecting location 42 for a blast air system 43 of the gathering and stapling machine. The blast air system 43 is provided in the area of the gathering section 4 with pipe sections 44, which are connected to each other and to the respective machine frame 7. With their large flow cross section and a length that extends nearly the complete length of the gathering and stapling machine, the blast air system 43 with its pipe sections 44 functions as blast air storage. From pipe segments 44 of a machine frame 7, a non-depicted blast air line respectively extends to a point of intersection 21 where a sheet feeder 5, a fold feeder 10, or the blind cover 20 is respectively fitted onto the machine frame 7. Blast-air lines which are not shown herein and are located inside the sheet feeders 5, the fold feeders 10, or the blind cover 20 conduct the blast air from the point of intersection 21 to an air supply 45. The air supply 45 is arranged above and on both sides of the gathering chain 15, approximately parallel to the conveying direction F for a printed product 6 or the printed-product stack 31. The air supply 45 is composed of two cylindrical pipes with several exit openings, distributed over its length and embodied as bores with a diameter of 0.5 to 2 mm, from which the air flows. The pipes for the air supply 45 are attached to the sheet feeder 5 or the machine frame 7, so as to rotate around their longitudinal axes. The direction of the outflowing blast air can thus be changed. With the aid of flow-control valves 50, which can be embodied as shut-off valves, the volume flow of the blast air can be adjusted manually and individually along the gathering section 4, in the region of the respective sheet feeder 5, the fold feeder 10, or the blind cover 20, either before or behind the gathering chain 15. In the region of the stapling device 25, as well as between the last machine frame 7 of the gathering section 4 and the stapling device 25, an air supply composed of pipes 45 with exit openings and flow-control valves 50 is arranged for regulating the blast air, similarly as in the region of the sheet feeders 5.

For producing printed products 2, stacks of folded printed sheets 6 are inserted according to the prior art into sheet hoppers 8 of the sheet feeders 5. Non-folded sheets 52 are placed into a sheet hopper 51 of the fold feeder 10 which is attached according to FIG. 1 at the end of the gathering section 4 to the machine frame 7. The first sheet feeder 5 uses a withdrawing drum 55, shown schematically in FIGS. 2 and 3, for withdrawing the lowest printed sheet 6 of the sheet stack 9 inserted into the sheet hopper 8 and conveys this sheet in the direction of the gathering chain 15. The printed sheet 6 is transferred by the withdrawing drum 55 to two opening drums 56. The opening drums 56 open the printed sheet 6 and deposit it on the gathering chain 15 moving below, such that the fold of the printed sheet 6 rests on the ridge 16. The opened sides of the printed sheet 6 rest on the guide sheets 18. With gathering chains without guide sheets 18, the printed sheets 6 are centered with their fold on the gathering chain 15 and the opened sides hang vertically downward beside the gathering chain 15. The opening drums 56 and the withdrawing drum 55, also called separating drum, comprise along the circumference non-depicted controllable grippers and/or vacuum suction cups for holding, accelerating and opening the printed sheets 6. Blast air is used to securely deposit the opened printed sheet 6 onto the gathering chain 15 that moves continuously in conveying direction F, even with higher production speeds or when using thinner paper.

Each additional sheet feeder 5 deposits the separated out printed sheets 6 onto the printed sheets 6 already positioned straddling on the gathering chain 15, thus forming several printed sheet stacks 31 which are conveyed one behind the other on the conveying chain 15. The fold feeder 10 frequently places a sheet 52 that is folded to form an envelope 11 on top of the printed sheet stack 31. Following the depositing onto the gathering chain 15 or the printed sheet stack 31, each printed sheet 6 or envelope 11 is slowed down slightly with the aid of braking elements, not shown, such as drag springs or brushes, so that a trailing edge 57 of the printed sheets 6 or the envelope 11 comes to rest against the following carrier 17. All gathered printed sheets 6 or the envelope 11 of the printed sheet stack 31, which can differ as to format, number of pages, type of paper and the like, consequently have a joint trailing edge 57. During the transport of a printed paper stack 31 on the gathering chain 15, there is danger that a still loose printed sheet 6 or envelope 11 is picked up by the movement air or an airflow and is displaced relative to the associated printed sheet stack 31 or is even lifted off partially or totally from the gathering chain. The leading free edges 58 of a printed sheet 6, positioned on the bottom, are frequently bent by the movement airflow toward the outside or the back. If a following printed sheet 6 or envelope 11 is deposited thereon, the bent edge can sometimes remain in the printed sheet stack 31, thus strongly reducing the quality of the finished printed product 2. Owing to the air supply 45 that is effective on both sides of the gathering chain and extends over the length of the gathering section 4 to the delivery 28, the above-mentioned blast air is utilized as well. For example, printed sheet stacks 31 transported on the gathering chain 15, for which the top printed sheet 6 has a large-format or is composed of thin and lightweight paper, require more blast air than printed sheet stacks 31 covered by a heavy or rigid envelope 11. The amount of blast air is manually adjusted via the flow-control elements 50, so that the correct amount of blast air flows from the air feed 45 in each region, corresponding to the production speed and the composition of the sheet stack 31. Not enough blast air can favor the aforementioned undesirable effects. Too much blast air can cause the printed sheets 6 to be ragged instead of supporting the change in position for the printed sheets and maintaining the desired position for the printed sheets 6 on the gathering chain 15. In the region of the quality control unit 30 and the stapling device 25, the air feed 45 is not arranged above the gathering chain 15, as is the case along the gathering section 4, but is arranged preferably at the level of the guide sheets 18. The air feed 45 can optionally be embodied such that it is adjustable, relative to the height and the distance to the gathering chain 15 and/or the guide sheets 18. The pipes for the air feed 45 can function as guide elements and can contribute to a secure and trouble-free transport of the printed sheet stacks 31 between gathering section 4 and stapling device 25, even with little or no blast air flowing out. The lower installation of the air feed 45, relative to the gathering section 4, is possible since downstream of the gathering section no additional printed sheets 6 or folded envelopes 11 are deposited opened or folded on the printed sheet stack 31.

Following the gathering operation on the gathering section 4, the printed sheet stacks 31 are checked in the quality control 30 by measuring the thickness and determining their completeness. Any printed sheets 6 with a fold that is not positioned precisely on the ridge 16 can also be detected by the quality control. Flawed printed page stacks 31 are not stapled in the stapling device 25 and are removed following the delivery. All other stacks 31 are provided in the stapling device 26 with the desired number of staples. In the delivery 28, the stapled printed sheet stacks 31 or the printed products 2 are removed from the gathering chain 15 with the ejector 29 and are supplied as described in the above, for example to a trimmer.

Figure 2:
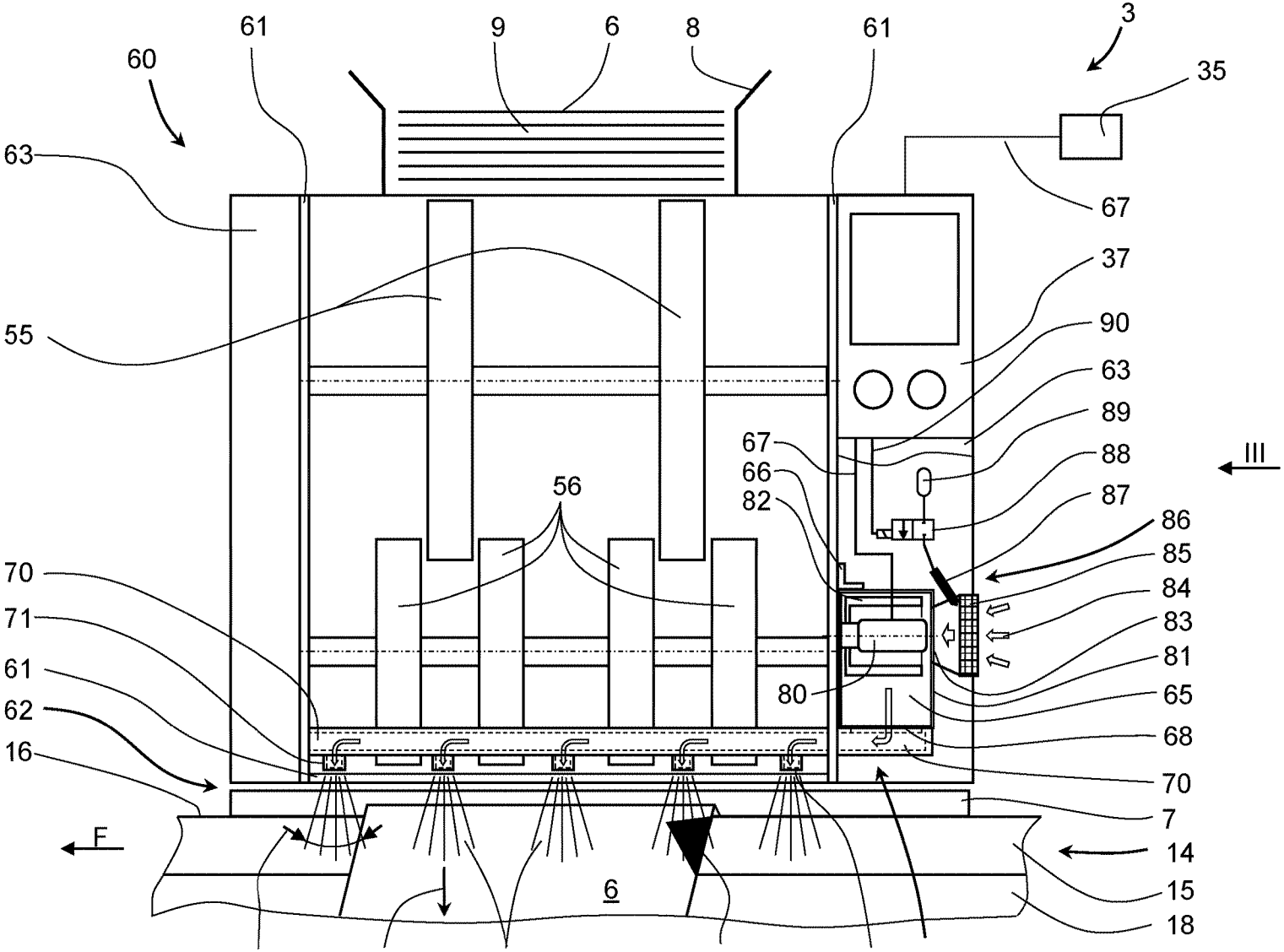
FIG. 2 A simplified representation of a device embodied as a sheet feeder for an apparatus according to the invention, with a blower for generating blast air.

FIG. 2 schematically shows a device 3, embodied as sheet feeder 60, for an inventive apparatus 1. The withdrawing drum 55 and the opening drums 56 are positioned inside a frame 61 as for the sheet feeders 5 shown in FIG. 1. The printed sheets 6 are inserted in a manner known per se as a vertically positioned sheet stacks 9 or, as shown in FIGS. 1 and 2, as a horizontal sheet stack into the sheet hopper 8. The sheet feeder 60 is connected via an intersection 62 to the machine frame 7. For this, the frame 61 of the sheet feeder 60 is fitted onto the machine frame 7 and is detachably mounted thereon. Lines of the sheet feeder 60 that are not shown herein and are used, for example, for compressed air, control signals, and electrical power, are connected via the intersection 62 to lines of the apparatus 1. However, in contrast to the intersection 21 of the sheet feeder 5 according to the prior art, the intersection 62 of the sheet feeder 60 does not have a connection for blast air. In addition to the local display and operating unit 37, numerous drive elements, bearing members, switching and control elements are attached to the frame 61, which are not shown herein and in part are covered by casings 63.

Figure 3:
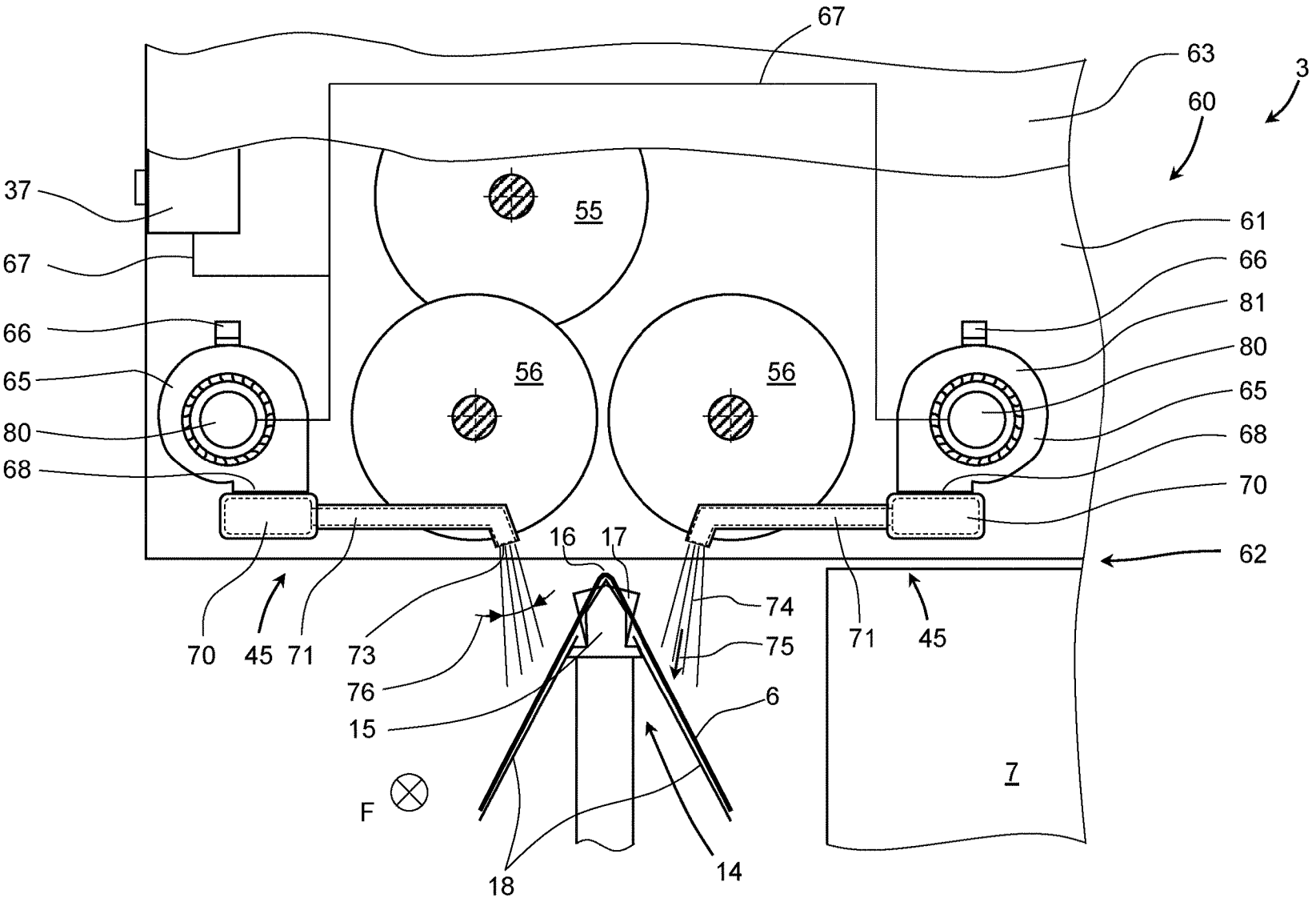
FIG. 3 A simplified representation of the sheet feeder according to FIG. 2, as seen in movement direction of the gathering chain.

The casing 63 on the right side of the sheet feeder 60 is shown in FIG. 2 in a sectional view below the local display and operating unit 37, to allow a view of the blower 65. As can be seen in FIG. 3, the blower 65 shown therein is embodied as compact radial blower which has a maximum overpressure of only 0.005 to 0.01 bar on the side of the air exit and delivers a volume flow of 1 to 5 $m^3$/minute. Also conceivable is the use of other types of blowers or fans, such as impeller fans, axial fans, ventilators without rotors, pipe ventilators or blowers with a Venturi pipe. The blower 65 is attached with a fastening element 66 to the frame 61 and is connected via control lines 67 to the local display and operating unit 37 or the control unit 35. A fastening element 66 which can be attached or detached without tools can be selected to dismantle the blower 65 easily and quickly, for example for cleaning purposes. Accordingly, the control lines 67 can be connected via a detachable plug connection to the blower 65, for an easy and quick decoupling.

Figure 4:
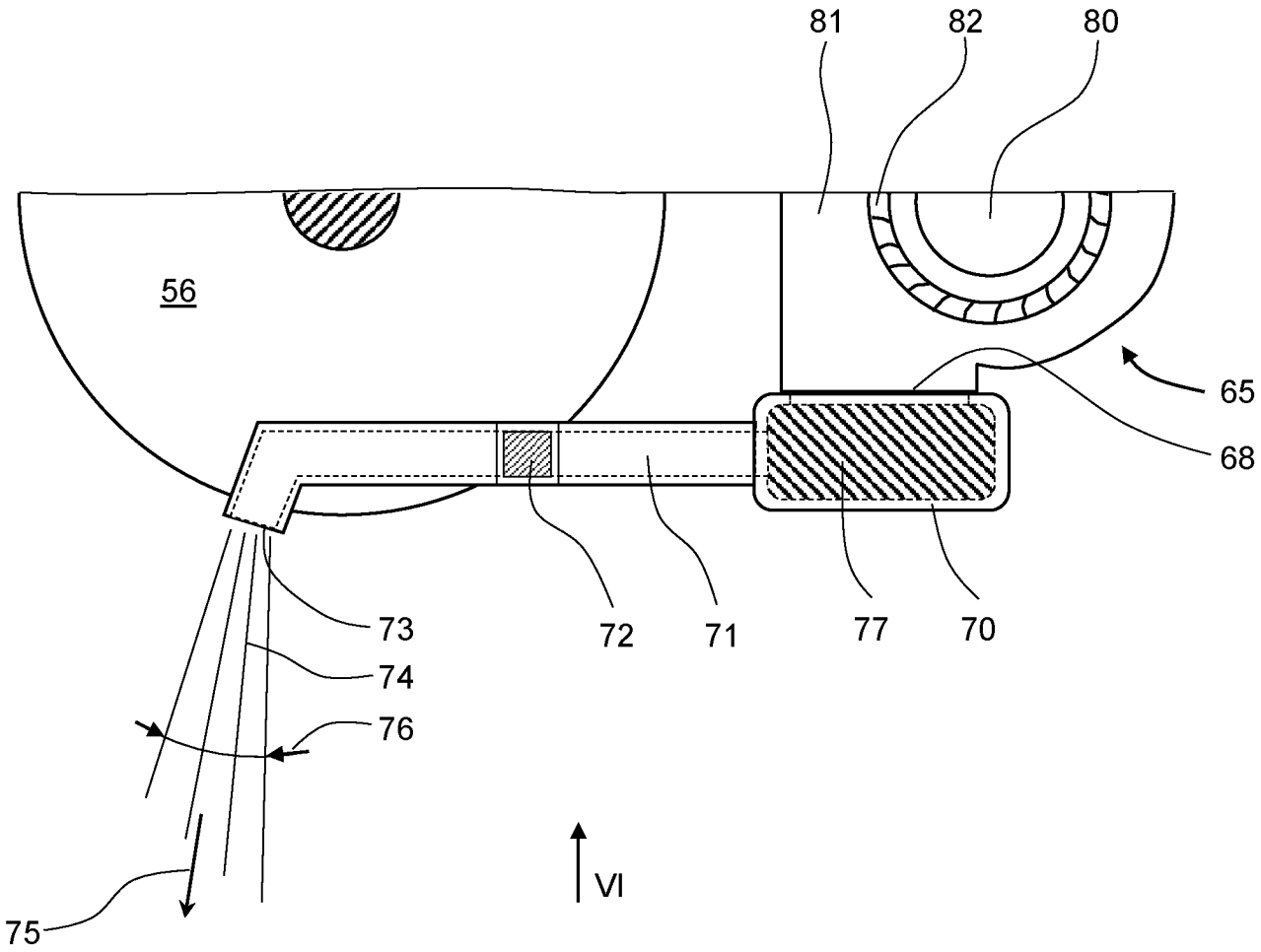
FIG. 4 An enlarged segment from FIG. 3.

A distribution channel 70 for blast air is arranged inside the frame 61, in the region of the opening drum 56. The distribution channel 70 adjoins an air outlet 68 of the blower 65. Blast pipes 71 are arranged spaced-apart on the distribution channel 70 in place of the small bores, as described for the aforementioned pipes for the air supply 45 according to the prior art. The blast air is conducted from the blower 65 via the distribution channel 70 and through the blast pipes 71, either to the region where a printed sheet 6 is supported for changing its position during the depositing onto the gathering chain 15, or the blast air is conducted to a region along the gathering section 4 where this blast air serves to maintain the position of a printed sheet 6 or an envelope 11, previously deposited on the gathering chain 15, and the guide sheets 18 during the transport. The blast pipes 71 have a continuous, relatively large flow cross section 72 throughout, as shown in FIG. 4, which can range from 10 to 2000 $mm^2$, advantageously from 50 to 400 $mm^2$, especially preferred from 100 to 200 $mm^2$. An exit opening 73 of the blast pipe 71 also has a flow cross section in the range of the aforementioned flow cross section 72. The blast pipes 71 and the exit opening 73 are embodied such that a blast air stream 74 exits in a desired direction 75, has a desired scattering angle 76, and exhibits the desired flow speed by having a corresponding flow cross section 72. The blast air stream 74 with low flow speed, but higher volume flow is intended to exert the desired impulse force onto the printed sheet 6. The impulse force generated with the inventive apparatus 1 is comparable to the impulse force that can be achieved according to the prior art with blast air that is compressed to 1 to 1.5 bar overpressure and small exit openings in the distribution channels.

The following mathematical formula shows how a change in the air mass m or the speed $\vec{v}$ affects the impulse force $\vec{p}$:

$$\vec{p} = m \cdot \vec{v}$$

If the speed of the blast air is reduced, the air mass which is directly connected to the volume of blast air must correspondingly be increased to obtain an identical impulse force.

FIG. 3 schematically shows a view from the side of the sheet feeder 60, for which the frame 61, the casings 63 and the drive and positioning components arranged below the casings 63 were mostly blanked out. The viewing direction corresponds to the conveying direction F of the gathering chain 15. It is obvious that before and after the gathering chain respectively one blower 65 is arranged in a sheet feeder 60, meaning left and right in FIG. 3, which is connected to respectively one distribution channel 70. Of course, both blowers 65 are connected to the local display and operating unit 37. As shown in FIGS. 2 & 3, the blowers 65 can be attached so as to be detachable with the fastening elements 66 to the frame 61 or can be attached directly to the distribution channels 70. It is conceivable that a blower 65 is connect to two or more distribution channels 70. It is furthermore conceivable that one distribution channel 70 is connected to two or more blowers 65 blowing the air with low pressure but high flow volume into the distribution channel 70. According to FIG. 4, the blast air generated by a blower 65 is blown with low overpressure into the distribution channel 70 that is connected to the blower 65. The distribution channels 70 have a flow cross section 77, for example ranging from 4 to 40 $cm^2$. A high blast air volume can flow with low pressure from the exit openings 73 in the blast pipes 71 because of the large flow cross section 77 of the distribution channels 70 and the large flow cross section 72 of the blast pipes 71. The blast pipes 71 have generously dimensioned exit openings 73 as compared to the small bores in the pipes of the air supply 45 according to the prior art. Since each device 3 of the inventive apparatus 1 comprises one or several blowers that are connected to the distribution channels 70 and the blast pipes 71, the distribution channels 70 have a relatively short length. For a gathering and stapling machine with sheet feeder 60, for example, the distribution channels 70 have a length of only 40 to 100 cm. Depending on the requirements, more or fewer blast pipes 71 are arranged at the distribution channel with constant or differing spacing, relative to each other.

FIG. 4 shows an enlarged section of the region of the opening drum 56 for a sheet feeder 60, as represented in FIG. 3. The cross-sectional surface 77 of the distribution channel 70 is marked by hatching. The flow cross section 72 of a blast pipe 71 is also marked by hatching in FIG. 4. In addition to the herein shown rectangular-flow cross sections, round, oval and other shapes are also conceivable. The blast pipes 71 and their exit openings 73 are embodied such that they emit the blast air stream 74 at the most ideal location possible, in a desired direction 75 and with an optimum scattering angle 76. The amount or flow volume and thus also the speed of the blast air stream 74 flowing out is determined by the blower 65. The control 35 controls the blower 65 by changing the rotational speed of a motor 80 for the blower 65. Changing the volume flow at constant blower speed via an adjustable and controllable throttle valve, for example arranged in the region of the air exit 68 of the blower 65, is also conceivable.

The blower 65 comprises a casing 81, with the motor 80 and an impeller 82 positioned therein. The casing 81 is designed such that the impeller 82, driven by the motor 80 and provided with blades, suctions in the ambient air 84 via an inlet opening 83 (FIG. 2), compresses this air, and allows it to flow into the distribution channel 70 via the air outlet 68. Gathering and stapling machines and other apparatuses 1 for producing printed products 2 are oftentimes operated in an environment where the ambient air 84 contains a higher share of paper dust and other types of dust. Over time, the dust can be deposited on the impeller 82 of the blower 65, thus reducing the volume flow generated by the blower and its pressure. At the same time, the rotational speed, respectively the energy consumption, of the motor 80 increases during the acceleration of the impeller 82 as a result of the dust deposits. The increase in the speed or the current consumption can be detected via the control unit 35. If a threshold value that is defined in the control unit 35 is exceeded, the control unit 35 sends a warning to the central control unit 36 or the local display and operating units 37. The user of the apparatus 1 cleans the blower 65, for example by detaching the fastening element 66, removing the blower 65 from the sheet feeder 60, and using blast air to clean it. It is furthermore conceivable to arrange an air filter 85 at the intake opening 83 of the blower 65 which filters out the dust from the suctioned-in ambient air before it enters the blower 65. After a certain amount of time, the air filter 85 will be clogged with enough dust, so that it must be cleaned or replaced. FIG. 2, for example, shows a cleaning device 86 that is embodied as air nozzle 87. When activating a pneumatic valve 88, the air nozzle 87 blows the dust from the filter with the aid of compressed air stored in a compressed air reservoir 89. The pneumatic valve 88 is connected via a control line 90 to the local display and operating unit 37. The cleaning operation can be triggered automatically via the control unit 35, either as soon as it is detected that the filter 85 is clogged with dust or at specified intervals defined by the user. Alternatively, the user could also manually trigger the cleaning operation, if necessary, via the local display and operating unit 37 or another operating unit. It is furthermore conceivable that the dust is removed by a vibration element that is connected to the filter 85 or the casing 81 of the blower 65 and is triggered by one of the above-described methods.

Figure 5:
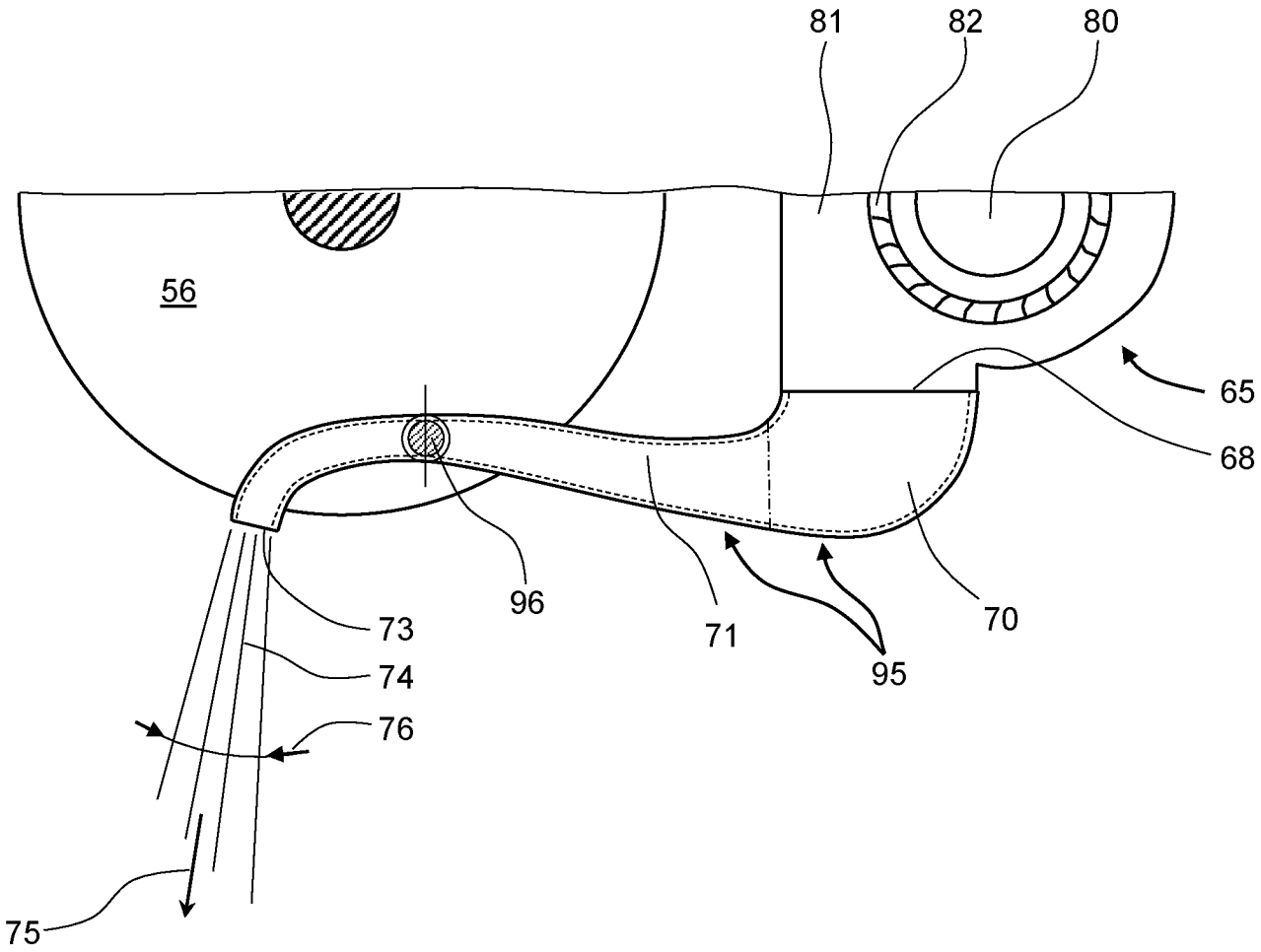
FIG. 5 An enlarged segment from FIG. 3, with a flow-optimized distribution channel for the blast air.

FIG. 5 shows an alternative design for a blast pipe 71. This pipe has a flow-optimized geometry 95 which allows generating a nearly laminar flow of blast air in the blast pipe 71 up to the exit opening 73. The nearly laminar flow has the same flow direction over a total cross section 96, perpendicular to the flow direction, and is thus free of swirling and turbulence. As a result, the impulse force of the blast air stream 74 is increased with the same flow speed and the same volume flow. The blast pipe 71 with flow-optimized geometry 95 can be connected directly to the air exit 68 of the blower 65, as shown in FIG. 5. It is also conceivable that the blast pipe 71 with flow-optimized geometry 95 is connected directly to an also flow-optimized distribution channel 70. Of course, the distribution channel 70 and the blast pipes 71, branching off therefrom, can also be embodied as a single part or as several parts.

Figure 6:
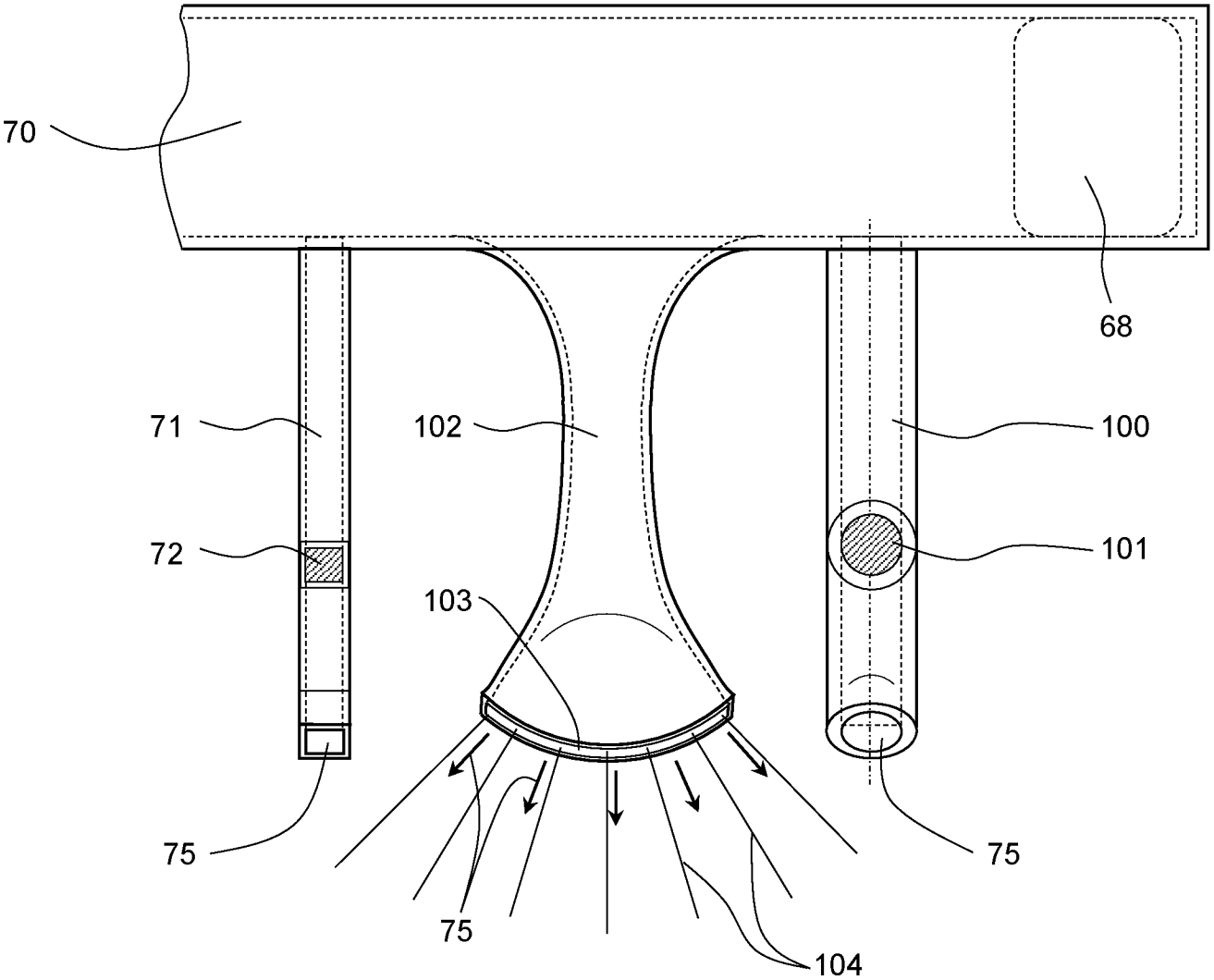
FIG. 6 A simplified view from below of variants of blast-air pipes connected to a distribution channel.

FIG. 6 shows a view from below of the distribution channel 70 and differently designed blast pipes 71, 100, 102. Shown on the left is the blast pipe 71 with rectangular flow cross section 72, which is also shown in FIGS. 3 and 4. On the right side, a blast pipe 100 is shown with a round flow cross section 101 which can be manufactured particularly easily through bending of the blast pipe 100 on the outlet side at the desired angle. A different blast pipe 102 with flow-optimized geometry is shown in FIG. 6, between the two blast pipes 71, 100. The blast pipe 102 has a slot-type outlet opening 103, with a rather flat but widely spread apart blast air stream 104 exiting therefrom and flowing in different directions 75. An outlet opening 73, 103 can also be embodied as elongated slot in the distribution channel, which extends over the complete length of the distribution channel or the device 3. Identical or different blast pipes 71, 100, 102 can also be arranged spaced-apart on a distribution channel 70 of a device 3. Also conceivable is that identical or different blast pipes 71, 100, 102 are arranged at a different angle, relative to a horizontal and/or vertical plane, on the distribution channel 70 or that these can be changed by means of a manual or automatic adjustment device.

If and how much blast air is required with a device 3 for the processing of printed sheets 6 to ensure an uninterrupted operation and to produce high-quality printed products 2 depends on various factors and parameters, for example on the production speed. As a rule, the blast air requirement increases with the movement speed of the machine. Other factors are the sheet format, the fold type, the type and grammage of the printed paper folded to form a printed sheet 6. In general, the blast air requirement increases with a larger sheet format and decreasing grammage. Another factor that influences the requirement for blast air is the use of guide elements. For example, guide elements extending along the gathering chain, which are oriented to correspond to the format of the printed sheet stack 31, prevent that the leading, free edges of a printed sheet 6 are bent backward during the transport because of the airflow. The use of guide elements, however, has the disadvantage that these frequently must be adapted to the format and thickness of the printed sheets 6 to be processed or the envelopes 11. The composition of the printed product 2, respectively a printed sheet stack 31 also influences the requirement for blast air. For example, if printed sheets 6 of very thin paper (=small grammage) are completely covered by a stiff envelope 11, it is possible to omit in part or completely the use of blast air during the transport of the printed sheet stacks 31 from the end of the gathering section 4 to the stapling machine. The arrangement of the devices 3, in particular the sheet feeders 60, also influences the need for blast air. Frequently, not all sheet feeders 60 of a gathering and stapling machine are needed for the production of a printed product 2. If the unused sheet feeders 60 are positioned at the start of the gathering section 4, (on the right side in FIG. 1), no blast air is needed in the region of the non-used sheet feeders 60. If one of the sheet feeders 60 is only partially operational during the production, the blast air required for a secure depositing of the opened printed sheet 6 on the gathering chain 15 needs to be available only if a printed sheet 6 is actually withdrawn from sheet stack 9, is opened and is deposited on the gathering chain 15. If a printed sheet 6 is supplied by an upstream-arranged sheet feeder 60 to the gathering section 4, it may be necessary to have blast air in the region of the non-operating sheet feeder 60 for the secure transport of the printed sheet 6 already deposited on the gathering chain 15. Also, if a blind cover 20 is attached to the machine frame 7 along the gathering chain 15 in place of a sheet feeder, blast air may be necessary at that location of the blind cover 20. With asymmetrically folded printed sheets 6, for which one sheet half is longer than the other one, the amount of blast air needed before and after the gathering chain 15 can differ. The same is true when affixing product samples to one of the pages of a printed sheet 6.

The aforementioned factors, also called parameters, which affect the need for blast air during the production of an order, can be stored in the control unit 35. They are transmitted from a super-imposed production system to the control unit, or entered into it via the central control unit 36 or the local display and user unit 37. In dependence on the parameters, the control unit 35 determines operating data for actuating the blowers 65. The operating data for each individual blower are stored for each order. With recurring orders, the stored settings for using the blast air can be called up. Blast air is therefore generated and blown out only at the instants and locations where it is actually needed and only in amounts which are required for a secure and reliable operation. Making use of this need-based control for each individual device 3 for processing printed sheets 6 via the blowers 65 is extremely energy-saving and reduces the noise generated by low flow speeds for the exiting blast air and by omitting the large and noisy compressors operating continuously. Also omitted is the manual triggering of flow-control valves 50 on all devices 3 for a change in a production order or if the aforementioned factors or parameters change during the operation. If an operator is required to adapt the blast air settings—location, instant and amount—during the production of printed products 2, it can be done at any time via the central operating unit 36 or the local display and operating unit 37 and the new values can be stored.

It is conceivable that not every blower 65 of a device 3 is actuated individually, as described in the above, but that the blowers of a single device 3 are actuated in groups by the control unit 35, using the same operating data. Also conceivable is an infinitely variable or multi-stage actuation of the blowers 65 by the control unit 35. A 3-stage actuation of the blowers 65 by the control unit 35 is possible, for example, that is to say in the $1^{st}$ stage the blowers are shut down; in the $2^{nd}$ stage the speeds are low and/or there is a low volume flow; in the $3^{rd}$ stage the speed is high and/or there is a high or maximum volume flow of blast air.

It will be understood that the above description of the present invention is susceptible to various modifications, changes, and adaptations, and that the same are intended to be comprehended within the meaning and range of equivalents of the appended claims.

The invention claimed is:

1. An apparatus for producing printed products, such as books, magazines, brochures, catalogues or the like, comprising:

a plurality of connected devices for processing printed sheets, wherein the printed sheets have an upper side and are supported from underneath in the connected devices;

a plurality of air supplies each dedicated to a respective one of the plurality of connected devices, each air supply including at least one blower that generates blast air, a distribution channel receiving the blast air from the at least one blower and at least two spaced apart blast-pipes arranged along the distribution channel for receiving the blast air from the distribution channel and dispensing the blast air toward the upper side of a respective one of the printed sheets in the respective connected device to press the respective printed sheet toward a support in the connected device so that the respective printed sheets processed by each connected device can be admitted with blast air on the upper side to change or maintain a position of the respective printed sheet; and a control unit arranged to separately control the blast air generated by each blower.

2. The apparatus according to claim 1, wherein at least one of the distribution channel and one of the at least two spaced-apart blast pipes have a flow-optimized geometry that reduces turbulence in the blast air.

3. The apparatus according to claim 1, wherein the distribution channel and the spaced-apart blast pipes are one piece.

4. The apparatus according to claim 1, wherein each blower has an outlet side and connected directly to the respective distribution channel.

5. The apparatus according to claim 1, wherein the at least two spaced-apart blast pipes respectively have a flow cross section for the blast air to flow through, with an area ranging from one of 10 to 2000 $mm^2$, 50 to 400 $mm^2$, and 100 to 200 $mm^2$.

6. The apparatus according to claim 4, wherein on the outlet side of each blower the blast air generated by the blower has a maximum overpressure of one of 0.1 bar, 0.01 bar, and 0.007 bar.

7. The apparatus according to claim 1, wherein two of the plurality of connected devices are sheet feeders; and further comprising a stapling machine and a gathering chain with a conveying element movable in a conveying direction through the sheet feeders so that separated out, opened printed sheets can be deposited on the conveying element and delivered to the stapling machine; wherein the air supply of at least one sheet feeder has a second distribution channel with spaced-apart blast pipes and the distribution channel with spaced-apart blast pipes and the second distribution channel with spaced-apart blast pipes are arranged on opposite sides of the gathering chain as seen in the conveying direction in the at least one sheet feeder; and wherein the blast air generated by the at least one of the blower is blowable out via the distribution channel and the second distribution channel and associated blast pipes arranged on opposite sides of the gathering chain in the at least one sheet feeder.

8. The apparatus according to claim 7, wherein a third one of the plurality of connected devices is constituted by the conveying element for transporting the printed sheets, and the printed sheets are admitted during transport by the conveying element of the third connected device with blast air coming from distribution channels and the blast pipes arranged along both sides of the conveying element of the third connected device.

9. The apparatus according to claim 1, wherein the blast air generated by the blowers is adjustable in dependence on parameters including at least one of a production speed, a type and grammage of printed paper folded to form the printed sheets, format of the printed sheets, number of pages or a type of fold for the printed sheets, a composition of the printed product, a use of guide elements, and an arrangement of the connected devices within the apparatus.

10. The apparatus according to claim 9, wherein the control unit determines operating data for the blowers in dependence on the parameters and the blowers are actuatable with aid of the operating data.

11. The apparatus according to claim 10, further including one of a local display with an operating unit and a central operating unit of the apparatus, wherein the parameters or the operating data for each blower of a connected device is changeable via the local display and operating unit or the central operating unit of the apparatus.

12. The apparatus according to claim 10, wherein the parameters and the operating data for each individual blower are storable in the control unit for a production order or for an operating mode, and can be called up again later in time.

13. A method for producing printed products such as books, magazines, brochures, catalogues and the like employing the apparatus of claim 1, comprising:

processing the printed sheets in the connected devices;

generating the blast air with aid of the blowers;

admitting the printed sheets with the generated blast air only in a region of the respective connected devices to change or maintain the position of the printed sheets; and controlling the blast air generated by a respective one of the blowers with the control unit.

14. The method according to claim 13, including flowing the blast air generated by the respective blower through the distribution channel of the at least one air supply and then through the at least two spaced-apart blast pipes of the distribution channel.

15. The method according to claim 14, including generating a nearly laminar flow of the blast air in at least one of the two spaced-apart blast pipes with aid of a flow-optimized geometry of the blast pipes.

16. The method according to claim 13, further including conducting the blast air at an outlet side of the at least one blower directly into the distribution channel of the respective connected device.

17. The method according to claim 13, further including compressing the blast air on an outlet side of at least one blower to a maximum overpressure of one of 0.1 bar, 0.01 bar, and 0.007 bar.

18. The method according to claim 14, wherein the at least two connected devices are sheet feeders of a gathering and stapling machine, and the method further includes using the sheet feeders to separate out, open up and deposit on a gathering chain moving in a conveying direction and the generating step includes generating the blast air by separate blowers and the admitting step includes blowing out the blast air via distribution channels and blast pipes arranged on left and right sides of the gathering chain, as seen in the conveying direction.

19. The method according to claim 13, including adjusting the blast air generated by the blowers in dependence on at least one of the following parameters: production speed of the apparatus, type and grammage of printed paper that is folded to form a printed sheet, format of the printed sheet, number of pages or type of fold of the printed sheet, composition of a printed product, use of guide elements, and arrangement of the connected devices within the apparatus.

20. The method according to claim 19, including determining operating data for the blowers by the control unit in dependence on the parameters, and actuating the blowers based on the operating data.

21. The method according to claim 20, including adjusting the parameters or the operating data of each blower of a connected device via a local display and operating unit arranged on the connected device or via a central operating unit for the apparatus.

22. The method according to claim 21, including storing in the control unit the parameters and the operating data for each individual blower for a production order or for an operating mode and calling up at least one of the parameters and operating data at a later point in time.

23. An apparatus for producing printed products, such as books, magazines, brochures, catalogues or the like, comprising:

a plurality of connected devices for processing printed sheets;

an air supply including blowers that generate blast air, wherein at least two of the connected devices are each arranged to use blast air of respectively one blower so that the printed sheets processed by each connected device can be admitted with blast air either to change or maintain a position of the printed sheets; and a control unit arranged to control the blast air generated by the blowers;

wherein the blast air generated by the blowers is adjustable in dependence on parameters including at least one of a production speed, a type and grammage of printed paper folded to form the printed sheets format of the printed sheets, number of pages or a type of fold for the printed sheets, a composition of the printed product, a use of guide elements, and an arrangement of the connected devices within the apparatus; and wherein the control unit determines operating data for the blowers in dependence on the parameters and the blowers are actuatable with aid of the operating data.

24. The apparatus according to claim 23, further including one of a local display with an operating unit and a central operating unit of the apparatus, wherein the parameters or the operating data for each blower of a connected device is changeable via the local display and operating unit or the central operating unit of the apparatus.

25. The apparatus according to claim 23, wherein the parameters and the operating data for each individual blower are storable in the control unit for a production order or for an operating mode, and can be called up again later in time.

26. A method for producing printed products such as books, magazines, brochures, catalogues and the like employing the apparatus of claim 23, comprising:

processing the printed sheets in the connected devices;

generating the blast air with aid of the blowers;

admitting the printed sheets with the generated blast air only in a region of the respective connected devices to change or maintain the position of the printed sheets;

controlling the blast air generated by the blower with the control unit;

adjusting the blast air generated by the blowers in dependence on at least one of the following parameters: production speed of the apparatus, type and grammage of printed paper that is folded to form a printed sheet, format of the printed sheet, number of pages or type of fold of the printed sheet, composition of a printed product, use of guide elements, and arrangement of the connected devices within the apparatus; and determining operating data for the blowers by the control unit in dependence on the parameters, and actuating the blowers based on the operating data.

27. The method according to claim 26, including adjusting the parameters or the operating data of each blower of a connected device via a local display and operating unit arranged on the connected device or via a central operating unit for the apparatus.

28. The method according to claim 26, including storing in the control unit the parameters and the operating data for each individual blower for a production order or for an operating mode and calling up at least one of the parameters and operating data at a later point in time.

* * * * *